United States Patent [19]

Sandberg et al.

[11] 4,137,604

[45] Feb. 6, 1979

[54] PROCESSOR-STACKER FOR PAPERED FOOD PATTIES AND LIKE LAYERED OBJECTS

[75] Inventors: Glenn A. Sandberg, Lockport; George N. Howe, New Lenox, both of Ill.

[73] Assignee: Formax, Inc., Mokena, Ill.

[21] Appl. No.: 847,703

[22] Filed: Nov. 2, 1977

[51] Int. Cl.[2] ..... A22C 7/00; B65G 57/00

[52] U.S. Cl. ..... 17/32; 53/500; 53/157; 53/540; 198/424; 214/6 DK

[58] Field of Search ..... 17/32; 53/157, 159, 53/59 R; 198/424; 214/6 DK; 271/191

[56] References Cited

U.S. PATENT DOCUMENTS

| | | | |
|---|---|---|---|
| 3,324,987 | 6/1967 | Kiesser | 198/424 X |
| 3,347,176 | 10/1967 | Hall | 17/32 X |
| 3,460,667 | 8/1969 | Lanham | 198/424 |
| 3,567,047 | 3/1971 | Clausen et al. | 214/6 DK |

*Primary Examiner*—Travis S. McGehee
*Attorney, Agent, or Firm*—Kinzer, Plyer, Dorn & McEachran

[57] ABSTRACT

A combination processing machine and stacker for papered food patties and like layered objects comprising an endless belt conveyor for transporting the previously assembled layered objects through a processing station; for hamburger patties the processing station may be a cuber, a garnish or seasoning applicator, or a cheese applicator. The discharge end of the conveyor belt is a stacking station at which the belt engages a nose sprocket and an idler sprocket both mounted on a shuttle reciprocably movable parallel to the conveyor path; when each layered object reaches an alignment stop at the end of the stacking station, the shuttle is shifted rapidly toward the input end of the conveyor, abruptly shortening the discharge end of the conveyor and dropping the object onto a stack accumulator below the shuttle with no change in orientation.

11 Claims, 6 Drawing Figures

PACKING STATION 55
STACKING STATION 13
PROCESS STATION 12
INPUT STATION 11
PAPER APPLICATOR 61
PATTY FORMER 60

PROCESSOR-STACKER FOR PAPERED FOOD PATTIES AND LIKE LAYERED OBJECTS

BACKGROUND OF THE INVENTION

In high volume manufacture of food products, particularly hamburger patties and other molded food products, it is frequently desirable to interleave the individual food products with separator sheets, usually paper sheets but sometimes plastic film or foil, and to stack the interleaved food products for packaging and shipment. In many high volume food product molding machines, such as the machines described in U.S. Pat. Nos. 3,887,964 and 4,054,967, the stacking and interleaving processes can be advantageously combined because the food products are discharged from the molding machine along a vertical path. Thus, the separator sheets can be projected into the vertical discharge path of the molding machine, the food products accumulating in interleaved stacks at the molding machine outlet. Effective and efficient paper interleaving and stacking devices of this kind are described in U.S. Pat. Nos. 3,675,387 and 3,952,478.

In some instances, however, it is desirable to carry out additional processing of hamburger patties or other food products, on an individual basis, after they have left the patty molding machine or other initial production equipment and prior to stacking. For example, it may be desirable to pass each food product through a cuber to form multiple depressions in the patty surface. In other instances, it may be desirable to add a layer of cheese or to apply seasoning or garnish ingredients to one surface of the patty. In systems of this kind, it is difficult to stack the food products accurately, particularly if separator sheets are applied to the individual food products as they leave the initial production machine.

The principal problem arises from the fact that virtually all stackers, other than those operating directly at the outlet of the molding machine, change the orientation of the food products to a substantial extent in the course of the stacking operation. Thus, in some stackers the food product is rotated through an angle of 180° in the course of the stacking procedure. This almost inevitably leads to displacement of the separator sheets from the food products, and precludes effective controlled stacking. In other stackers, the patties or other food products may not be turned over completely, but they are tilted or otherwise changed in orientation enough so that accurate alignment of the separator sheets with the food products cannot be consistently maintained.

SUMMARY OF THE INVENTION

It is a principal object of the present invention, therefore, to provide a new and improved stacker-processor for food patties or other like layered objects, incorporating an endless belt conveyor, that processes and stacks the layered objects without change of orientation so that the layer alignment is not disturbed.

A further object of the invention is to provide a new and improved stacker for the discharge end of an endless belt conveyor that is capable of stacking papered food patties or other like layered objects without appreciable change of orientation and that is adaptable to use with a conveyor on which a varying number of objects are transported in sequential rows extending transversely of the conveyor.

Another object of the invention is to provide a new and improved stacker-processor, utilizing an endless belt conveyor, that permits cubing or other processing of plural-layer food products passing along the conveyor and stacks those products at the discharge end of the conveyor, all with no appreciable change of orientation.

A further object of the invention is to provide a new and improved stacker and stacker-processor for papered food patties or like layered objects moving along an endless belt conveyor that is simple and economical in construction and dependable in operation and can be adjusted to varying stack height requirements.

Accordingly, the invention relates to a stacker-processor for papered food patties or like layered objects; the stacker-processor comprises an endless belt conveyor including a generally horizontal conveyor run for transporting layered objects from an input station to a discharge-stacking station, and process means, located at a process station intermediate the input station and the discharge-stacking station, for processing the upper layer of each object traversing the process station of the conveyor. A shuttle is provided at the discharge-stacking station with shuttle drive means for shifting the shuttle along a horizontal path between an extended position and a retracted position; a nose sprocket is mounted on the upper outer end of the shuttle, and an idler sprocket is mounted on the lower inner end of the shuttle, both sprockets engaging the conveyor belt. Shuttle control means, responsive to arrival of an object on the conveyor at a discharge position adjacent the extended position of the nose sprocket, actuates the shuttle drive means to shift the shuttle rapidly to its retracted position, abruptly shortening the discharge end of the conveyor and discharging the object to fall freely onto a stack accumulator below the shuttle with no appreciable change in orientation; the shuttle control means further actuates the shuttle drive means to shift the shuttle back to its extended position in time to preclude premature discharge of the next object on the conveyor.

DESCRIPTION OF THE PREFERRED EMBODIMENT

Figures 1, 2, 3, 4:
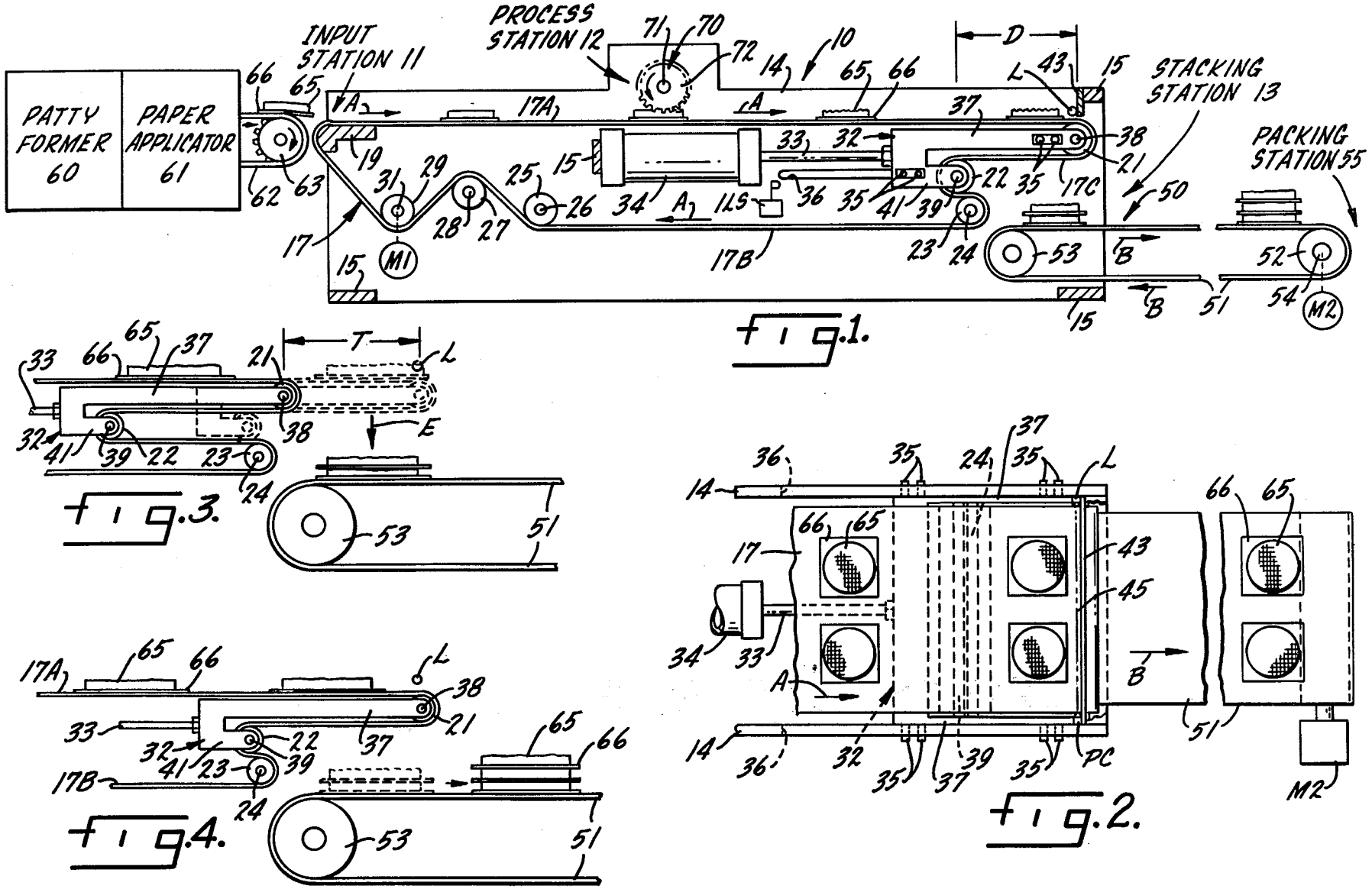
FIG. 1 is a partly schematic simplified side elevation view of a combined stacker and processor constructed in accordance with a preferred embodiment of the invention, with one side frame of the machine removed to reveal operating components.
FIG. 2 is a plan view of the stacking station of the apparatus of FIG. 1.
FIGS. 3 and 4 are schematic elevation views of the stacking station of the apparatus of FIG. 1 in varying operational conditions.

FIG. 1 illustrates a stacker-processor machine 10 constructed in accordance with a preferred embodiment of the present invention and including, from left to right, an input station 11, a process station 12, and a discharge-stacking station 13. Machine 10 comprises two side frames 14 (see FIG. 2) interconnected by appropriate cross frame members 15.

Machine 10 includes an endless belt conveyor comprising a belt 17 that extends from input station 11 through process station 12 to stacking station 13. Belt 17 is preferably of open mesh stainless steel construction. The upper conveyor run 17A of belt 17 extends around a fixed guide 19 at input station 11. At stacking station 13, the upper run 17A of belt 17 terminates as the belt extends around a nose sprocket 21. From nose sprocket 21, the belt continues around an idler sprocket 22 in an extension run 17C and then around a stationary return sprocket 23 mounted on a fixed shaft 24. The lower or return run 17B of belt 17 extends from sprocket 23 into engagement with two successive idler sprockets 25 and 27, mounted on shafts 26 and 28 respectively, near input station 11. From sprocket 27, which may be adjustable in position to vary the tension on belt 17, the belt extends around a drive sprocket 29 and back to guide 19. Drive sprocket 29 is mounted upon a drive shaft 31 driven from an electric motor M1. The direction of travel for belt 17 is indicated by the arrows A.

A slide or shuttle 32 is located at the discharge end of conveyor 17, at stacking station 13 and is connected to a shuttle drive cylinder 34 by a piston rod 33. Shuttle 32 extends across machine 10, as shown in FIG. 2, and includes guide projections 35 at both sides. The shuttle guide projections 35 engage in guide slots 36 in frame members 14 (see FIGS. 1 and 2) to guide the shuttle between an extended position shown in FIGS. 1, 2 and 4 and a retracted position illustrated in FIG. 3. The nose sprocket 21 is mounted at the outer end of an upper arm 37 of shuttle 32, on a shaft 38. The idler sprocket 22 is mounted on a shaft 39 at the outer end of a shorter lower arm 41 also comprising an integral part of shuttle 32. The idler sprocket 22 is located below nose sprocket 21 and is displaced toward the input station from the nose sprocket by a distance D (FIG. 1) substantially greater than the length of any of the objects to be processed by machine 10.

At stacking station 13, a fixed stop member 43 is mounted between frame members 14, extending across the discharge end of conveyor belt 17 immediately above the extended position for nose sprocket 21. A light source L is mounted adjacent stop 43 at one side of machine 10 and a photocell PC is mounted adjacent stop 43 at the other side of the machine in position to receive a light beam 45 projected across stacking station 13 from light source L (FIG. 2).

A stack accumulator 50 projects into stacking station 13. In the form illustrated, stack accumulator 50 comprises an endless belt conveyor 51 extending around a drive pulley 52 and a tensioning pulley 53. Drive pulley 52 is mounted on a drive shaft 54 driven from a pack-off drive motor M2. The outer end of conveyor 51 comprises a packing station 55. The inner end of conveyor 51 is positioned at a stacking location immediately below shuttle 32. The direction of travel for conveyor 51 is indicated by arrows B. Preferably, a separate frame is provided for the pack-off conveyor 51, but has not been shown in the drawings.

In FIG. 1, a patty forming machine 60 is shown located near the input station 11 of machine 10. It should be understood that patty former 60 represents any source of food products or other layered objects to be processed in machine 10. By way of example, the patty former may comprise a machine of the kind shown in U.S. Pat. No. 3,887,964 or in U.S. Pat. No. 4,054,967. A paper applicator 61 is associated with the output of patty former 60; the paper applicator of U.S. Pat. No. 3,952,478 is quite suitable. The patty former and paper applicator mechanisms terminate in an output conveyor 62 extending around a sprocket 63 located very closely adjacent input station 11 of machine 10. The output from the patty former and paper applicator mechanisms 60 and 61 comprises a series of hamburger patties or like food products 65 each resting on a separator sheet 66 of paper or other suitable material. In the following description and in the claims, the output from machine 60 and 61 is referred to as "papered food patties or like layered objects"; this expression should be understood to include separator sheets formed of materials other than paper and to include loosely adherring or non-adherring plural layered objects other than food patties.

In machine 10, process station 12 comprises a cuber 70 including a shaft 71 that extends transversely of the frame members 14 above the upper run 17A of conveyor belt 17. A multiplicity of multiple-blade cuber knives 72 are mounted on shaft 71 in position to engage the upper surface of each food patty 65 passing through process station 12. Shaft 71 is continuously rotated by appropriate drive means (not shown); the cuber can be driven from conveyor drive motor M1.

Cuber 70 is only one example of the kind of process apparatus that may be incorporated in station 12 of machine 10. The process apparatus can be quite different in construction and operation. For example, if the output of machine 10 is to be pre-assembled cheeseburger units, cuber 70 may be replaced by an appropriate apparatus for depositing a slice of cheese on each food patty 65 passing through station 12. On the other hand, if food patty 65 is a dough form for a pizza crust, presumably of modest size, then the processor apparatus located at station 12 may constitute equipment for depositing one or more pizza ingredients, such as sausage, grated cheese, or other appropriate ingredients, onto the upper surface of each patty 65. Another process apparatus for station 12 is a paper applicator to apply a second separator sheet to the top of patty 65, an arrangement desirable for some food products. A further alternative is an applicator to apply spices or other condiments to the food products. Of course, there may be more than one process station 12 between input station 11 and stacking station 13.

In considering operation of the stacker-processor 10, it may be assumed that motor M1 is continuously energized so that drive shaft 31 and drive sprocket 29 rotate continuously and maintain conveyor belt 17 in steady continuous motion. Motor M2 for stack accumulator 50, on the other hand, is normally de-energized so that its drive sprocket 52 and conveyor belt 51 are stationary. The drive for cuber mechanism 70 is continuously energized. With these conditions established, patty former 60 and paper applicator 61 may be set in operation to initiate a steady stream of papered food patties 65, 66 discharged from conveyor 62 into the input station 11 of machine 10. The patties may be in sequential rows with two or more patties in each row; see FIG. 2.

Each food patty 65, as it passes through process station 10, has a series of depressions cut into its upper surface by the multiple knives 72 of cuber 70. The depth of the cuber depressions may be regulated by adjustment of the height of the cuber shaft 71 relative to the upper run 17A of conveyor 17 so that machine 10 can accommodate patties of varying thickness.

Each time a food patty 65 reaches stacking station 13 it interrupts the light beam 45 between light source L and photocell PC (FIG. 2). The alignment of the light source and photocell with respect to fixed stop 43 is such that the light beam is interrupted just before a row of food patties reaches stop 43; continuous operation of conveyor 17 and an adjustable time delay in the photodetector circuit assures completion of movement of the food patties into engagement with stop 43 so that each food patty is accurately aligned in the stacking station.

The interruption of light beam 45 actuates a control for the shuttle drive cylinder 34. The shuttle drive cylinder then rapidly shifts shuttle 32 from its extended position (FIGS. 1, 2 and 4) to its retracted position (FIG. 3). As a consequence, the discharge end of conveyor 17 is abruptly shortened and the patty (or row of patties) is discharged to fall freely onto the stack accumulator conveyor 51 as indicated by arrow E in FIG. 3. The free-fall discharge movement of each papered patty 65, 66 is accomplished with no appreciable change in orientation and the alignment of the patty and its accompanying separator paper 66 is not disturbed. Rapid movement of the shuttle to its retracted position is essential to achievement of this constant-orientation mode of operation; a gradual movement will allow the patties to tilt too much and will cause misalignment of the patties and separator sheets in the stack.

The travel distance T of shuttle 32, in moving from its extended position to its retracted position, is made as short as practically possible, but must be at least somewhat greater than the overall length of each of the papered patties 65, 66 longitudinally of conveyor 17. Preferably, the shuttle travel distance T is made approximately equal to the spacing D between sprockets 21 and 22 (FIG. 1), but this is not critical.

As shuttle 32 reaches its retracted position, the shuttle engages a limit switch 1LS (see FIG. 1) that functions as a shuttle movement sensor. When this occurs, the operation of the shuttle drive cylinder 34 is reversed and the cylinder begins to drive shuttle 32 from its retracted position back toward its extended position. Shortly after the shuttle again reaches its extended position, the next papered patty 65, 66 reaches the end of its travel into stacking station 13 and the operations described above are repeated. Thus, this next patty (or row of patties) is discharged, by free fall, onto the top of the first patty. Again, there is no change of orientation for the papered patties.

A counter, preferably actuated by limit switch 1LS, counts the retraction movements of shuttle 32 as a means to determine the number of patties present at any given time at the stacking location on conveyor 51 in the bottom of station 13. When the counter reaches a preset stack number, indicating accumulation of a desired number of patties in the stack, motor M2 is energized for a given interval to transport the stack away from the point of accumulation and again present an empty section of pack-off conveyor 51 available for accumulation of another stack; see FIG. 4.

For effective operation of stacker-processor 10, the movement of shuttle 32 from the extended position of FIG. 1 to the retracted position of FIG. 3 must be accomplished quite rapidly. Withdrawal of the shuttle to retracted position, as shown in FIG. 3, at a slow or even moderate speed, would cause each papered patty or like layered object 65 to tilt or rotate to an undesirable extent and thus would cause an undesirable alteration in the orientation of the layers of the object with respect to each other. Thus, the retraction speed of shuttle 32 is preferably made substantially greater than the speed of conveyor belt 17. On the other hand, a correspondingly high speed of operation in the reverse movement of shuttle 32 from its retracted position (FIG. 3) to its extended position (FIG. 4) is not necessary and is actually somewhat undesirable as placing unnecessary stress upon the shuttle and its drive. Accordingly, it is preferred that the return movement of the shuttle to extended position be accomplished at a speed equal to or only slightly in excess of the speed of conveyor belt 17. This rate of return is sufficient to assure a return of shuttle 32 to its extended position in time to preclude premature discharge of the next patty while subjecting the stacker mechanism to minimum stress.

A mechanical drive, for example a rack and pinion drive, could be employed for shuttle 32. However, with a mechanical drive it is difficult to achieve the acceleration necessary for the desired rapid withdrawal of shuttle 32 and it is even more difficult to correlate a high speed withdrawal movement with a return movement of substantially reduced speed. Consequently, it is preferred that the shuttle drive constitute a fluid pressure cylinder such as cylinder 34. A hydraulic cylinder could be utilized in the drive; in many instances, however, a pneumatic drive is preferable FIG. 5 illustrates a simple yet highly effective pneumatic drive for shuttle 32.

Figure 5:
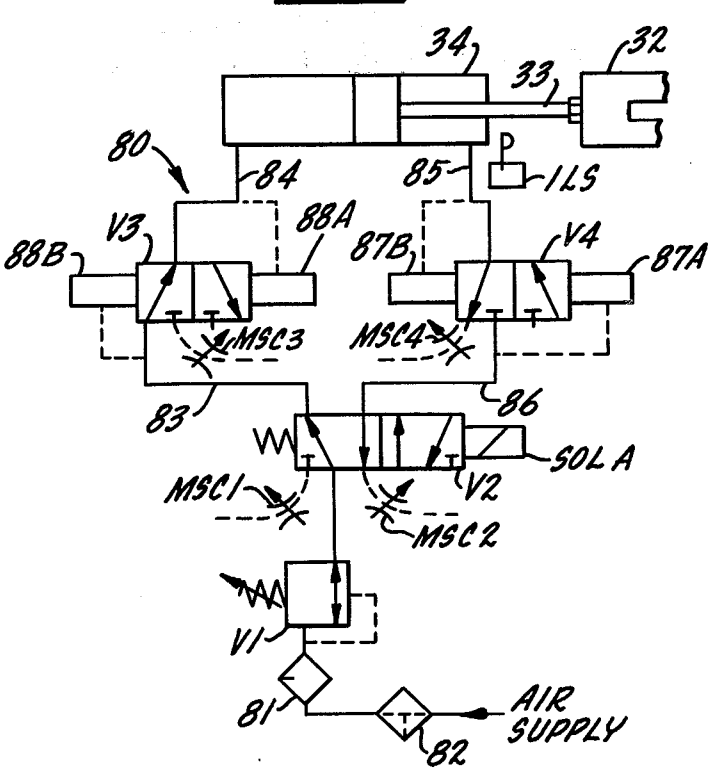
FIG. 5 is a schematic diagram of a pneumatic shuttle drive for the apparatus of FIGS. 1–4.

The pneumatic shuttle drive 80 illustrated in FIG. 5 includes a solenoid actuated two-way spring-return master control valve V2 connected to a suitable air supply through a pressure regulator valve V1, a lubricator 81, and a filter 82. The left-hand section of valve V2, with the valve in its de-energized condition as illustrated, connects regulator V1 through line 83, a quick exhaust valve V3, and a line 84 to the left-hand side of cylinder 34. For this condition the right-hand side of cylinder 34 is returned to the atmosphere through a line 85 and a quick exhaust valve V4. When the solenoid SOL A of valve V2 is energized, the right-hand side of valve V2 connects the output of regulator V1 to the right-hand side of cylinder 34 through a line 86, valve V4, and line 85 with the left-hand side of the cylinder being returned to the atmosphere through line 84 and valve V3. The pneumatic drive 80 of FIG. 5 also includes four muffler speed control devices MSC1 through MSC4. These speed control devices are utilized to regulate the speed of operation of the piston in cylinder 34 and thus regulate the travel speed for shuttle 32.

Figure 6:
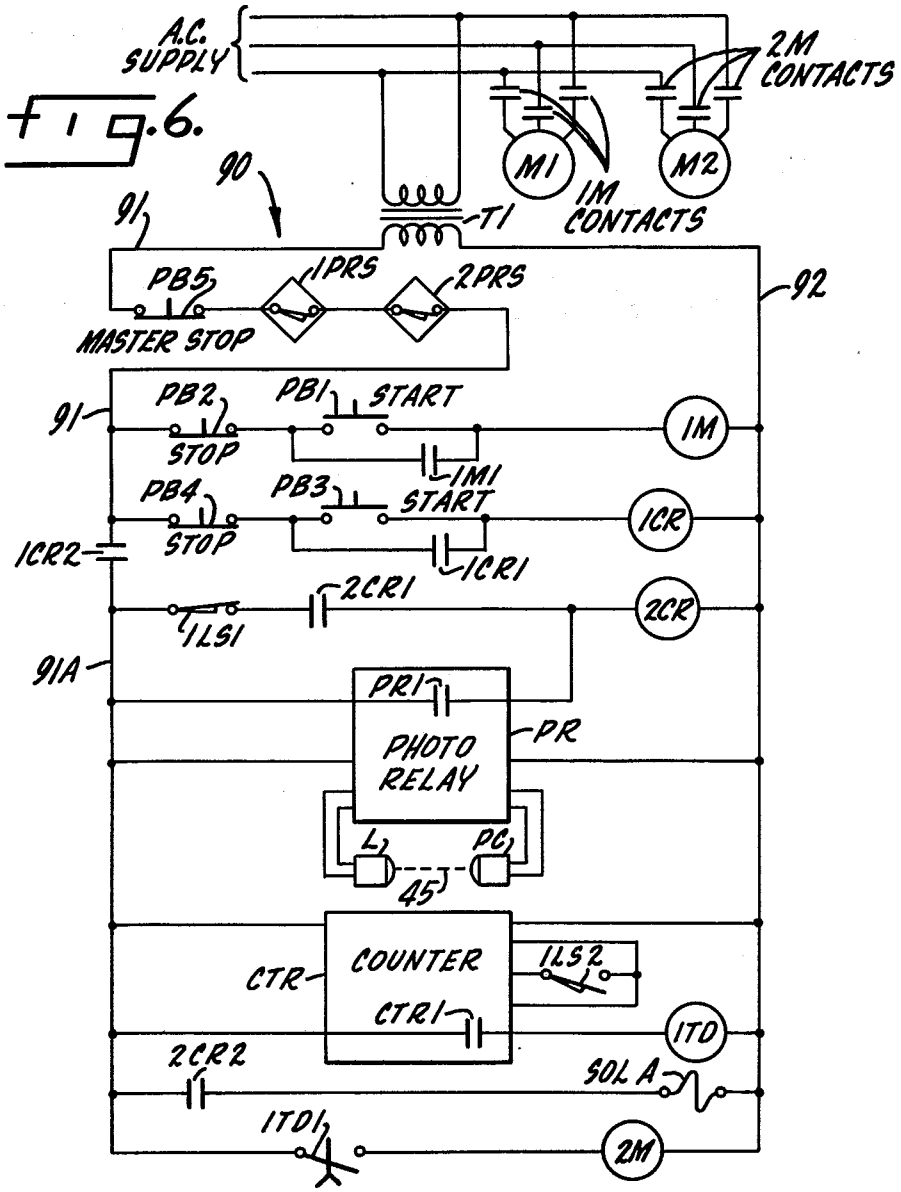
FIG. 6 is a schematic diagram of an electrical control for the apparatus of FIGS. 1–5.

FIG. 6 illustrates an electrical control 90 for processor-stacker 10 and stack accumulator 50. To start operation, the machine operator closes a conveyor start switch PB1 to energize the coil 1M of a first motor contactor through a circuit afforded by two power supply conductors 91 and 92 connected to the secondary of a transformer T1. With coil 1M energized, contacts 1M1 close to provide a holding circuit in parallel with switch PB1 so that coil 1M remains energized when the operator releases the switch. In addition, the 1M contacts in the operating circuit for motor M1 are closed. Motor M1 is now energized and conveyor 17 (FIG. 1) is placed in continuous operation.

Next, the operator closes a stacker start switch PB3, FIG. 6, energizing a master control relay coil 1CR. A set of contacts 1CR1 close, establishing a holding circuit to keep coil 1CR energized when the operator releases switch PB3. In addition, another set of contacts 1CR2 close to connect conductor 91 to another line 91A and provide for subsequent operation of the remaining circuit components in control 90. These are the only operations performed by the operator; all other actions in control 90 are initiated by the papered food patties.

When the first food patty interrupts the light beam 45 between light source L and photocell PC (FIGS. 1, 2 and 6) a photo relay PR is actuated to close its contacts PR1 (FIG. 6). This completes an energizing circuit for a control relay coil 2CR and the contacts 2CR1 of this relay close to establish a holding circuit for the coil. In addition, another set of contacts 2CR2 close, energizing solenoid SOL A. With solenoid SOL A energized, valve V2 is shifted to its alternate position, from the position shown in FIG. 5, so that a higher pressure is applied to a right-hand pneumatic actuator 87A for valve V4 than to its left-hand actuator 87B. Accordingly, valve V4 is actuated to its alternate condition to complete a connection of high pressure air to the right-hand side of cylinder 34; connection starts with the air supply and extends through filter 82, lubricator 81, pressure regulator valve V1, master control valve V2, line 86, exhaust valve V4, and line 85. At the same time, with line 83 now vented to the atmosphere through valve V2, the pressure to the right-hand pneumatic actuator 88A of valve V3 is greater than that to the left-hand actuator 88B and valve V3 is also actuated to its alternate operating condition. As a consequence, the left-hand side of cylinder is vented to the atmosphere through line 84, valve V3, and muffler speed control MSC3. Consequently, the piston in cylinder 34 is driven to the left and drives shuttle 32 to its retracted position.

At the beginning of the shuttle retraction movement, the retraction speed is governed by muffle speed control MSC1 connected to valve V2. When valve V3 is actuated, continuing speed control is exercised by unit MSC3.

As shuttle 32 moves from its extended position to its retracted position, the food patty that had interrupted light beam 45 falls out of the beam path. As a consequence, photorelay PR (FIG. 6) is de-energized and its contacts PR1 open. However, control relay coil 2CR remains energized through its contacts 2CR1, keeping contacts 2CR2 closed and maintaining solenoid SOL A energized. Thus, the pneumatic drive 80 of FIG. 5 continues to drive the shuttle toward its full retracted position. When the shuttle reaches its retracted position, it actuates limit switch 1LS (FIG. 5), opening a first section 1LS1 of this switch and closing another section 1LS2 (FIG. 6).

The closing of limit switch section 1LS2 causes a counter CTR to record one count. Counter CTR is a settable counter that is set to the number of food patties desired in each stack. Assuming that the setting is for some number greater than one, the recording of this first count in counter CTR does not further affect operation. However, the opening of limit switch section 1LS1 de-energizes coil 2CR. Contacts 2CR1 and 2CR2 both open. With contacts 2CR2 open, solenoid SOL A is de-energized to initiate a return movement of the shuttle to its extended position.

With solenoid A de-energized, the master control valve V2 (FIG. 5) returns to its original position as shown in FIG. 5, connecting the high pressure input from valve V1 to valve V3 and venting valve V4 to the atmosphere through muffler speed control MSC2. As a consequence, both of the pressure-controlled quick-exhaust valves V3 and V4 are actuated to return to their original operating conditions, as illustrated, so that high pressure air is applied to the left-hand side of cylinder 34 and the right side of the cylinder is vented to the atmosphere. Accordingly, shuttle drive 80 operates to shift the shuttle back toward its extended position, with the shuttle speed regulated first by device MSC2 and subsequently by device MSC4. Shortly after the shuttle reaches its extended position, the next patty interrupts the light beam 45 (FIG. 6) and the operations described above are performed another time.

If counter CTR is set for a stack height of three patties, when limit switch 1LS2 closes on the third retraction movement of shuttle 32 and a counter of three is recorded in counter CTR the counter contacts CTR1 close to complete an energizing circuit for a time delay relay coil 1TD (FIG. 6). This closes a set of contacts 1TD1 and completes an energizing circuit for the motor 2M of the pack-off conveyor 51 that constitutes the stack accumulator for the system. Contacts 1TD1 remain closed for a predetermined interval, established by the setting of the time delay relay, and then open. The energization time for motor 2M is selected to be sufficient to advance conveyor 51 by a distance sufficient to clear stacking station 13 for accumulation of a new stack. Subsequently, with continuing operation of the system, the stack reaches packing station 55 for packaging.

Control 90 (FIG. 6) is provided with appropriate stop switches PB2 and PB4 for normal shutdown. A master stop switch PB5 may also be connected in series in power line 91. The control may also include appropriate safety switches, shown as proximity switches 1PRS and 2PRS in series with power line conductor 91. These safety switches may be associated, for example, with safety guards for process station 12 and stacking station 13, which could present some danger to the operator if appropriate guards were not in place.

From the foregoing description, it will be apparent that stacker-processor 10 effectively stacks the papered food patties 65, 66, in stacking station 13 at the discharge end of conveyor 17, without change of orientation so that alignment of the food patties and separator sheets is not disturbed. The stacker is adaptable to belt conveyors of varying width to accommodate different supply sources; rows of two or more patties side by side on the conveyor are stacked effectively and efficiently. If some limited longitudinal misalignment occurs between patties in a given row, they are re-aligned by engagement with stop 43; corrections as large as one-half inch are readily achieved. In machine 10, each of the patties is cubed as it traverses process station 12. Other processing could be carried out at that station, or at additional process stations, as noted above. By simple adjustment of counter CTR, the stack height for the machine can be readily adjusted, accommodating varying requirements such as a change in the thickness of the individual food patties 65. Of course, it will be recognized that machine 10, and particularly the stacking apparatus incorporated in machine 10, can also be applied to other layered objects for which it is essential that the orientation be maintained constant during the stacking operation.

We claim:

1. A stacker-processor for papered food patties or like layered objects comprising:

an endless belt conveyor including a generally horizontal conveyor run for transporting layered objects from an input station to a discharge-stacking station;

process means, located at a process station intermediate the input station and the discharge-stacking station, for processing the upper layer of each object traversing the process station on the conveyor;

a shuttle at the discharge-stacking station;

shuttle drive means for shifting the shuttle along a horizontal path between an extended position and a retracted position;

a nose sprocket mounted on the upper outer end of the shuttle;

an idler sprocket mounted on the lower inner end of the shuttle, both sprockets engaging the conveyor belt;

shuttle control means, responsive to arrival of an object on the conveyor at a discharge position adjacent the extended position of the nose sprocket, for actuating the shuttle drive means to shift the shuttle rapidly to its retracted position, abruptly shortening the discharge end of the conveyor and discharging the object to fall freely onto a stack accumulator below the shuttle with no appreciable change in orientation;

the shuttle control means further actuating the shuttle drive means to shift the shuttle back to its extended position in time to preclude premature discharge of the next object on the conveyor;

counter means, pre-settable to any desired stack count within a given range, for counting movements of the shuttle to its retracted position;

and stack accumulator control means for actuating the stack accumulator to remove a stack of objects from the discharge-stacking station each time the preset count is recorded in the counter means.

2. A stacker-processor according to claim 1 in which the process means comprises a rotary multi-blade cubing knife for forming a plurality of depressions in the upper layer of each object traversing the process station.

3. A stacker-processor according to claim 1 and further comprising a fixed stop member extending transversely of the conveyor belt at the discharge end of the belt to assure consistent alignment of the objects as stacked.

4. A stacker-processor according to claim 1 in which the shuttle drive means shifts the shuttle to its retracted position at a speed substantially greater than the conveyor belt speed but returns the shuttle to its extended position at a much lower speed, equal to or only slightly greater than the conveyor belt speed.

5. A stacker-processor according to claim 4 in which the shuttle drive means comprises a double-acting fluid cylinder and piston, and in which the speed of shuttle movement is controlled by adjustment of the rate of exhaust of fluid from the cylinder, and in which the shuttle control means comprises a photoelectric sensor actuated by the object interrupting a light beam projected across the discharge end of the conveyor with the shuttle in extended position.

6. A stacker for stacking papered food patties or like layered objects at the discharge end of an endless belt conveyor without change of layer orientation, comprising:

a shuttle located at the discharge end of the conveyor;

a nose sprocket mounted on the shuttle;

an idler sprocket mounted on the shuttle below the nose sprocket and displaced toward the input end of the conveyor from the nose sprocket, both sprockets engaging the conveyor belt;

a stationary return sprocket located below the idler sprocket;

shuttle drive means for shifting the shuttle between an extended position and a retracted position;

object sensor means for sensing the arrival of an object on the conveyor at a discharge position adjacent the extended position of the nose sprocket;

shuttle control means, responsive to the object sensor means, for actuating the shuttle drive means to shift the shuttle rapidly to its retracted position, abruptly shortening the discharge end of the conveyor and discharging the object to fall freely onto a stack accumulator at a stacking location below the shuttle with no appreciable change in orientation;

the shuttle control means further actuating the shuttle drive means to shift the shuttle back to its extended position in time to preclude premature discharge of the next object on the conveyor;

a counter, included in the control means, for counting movements of the shuttle; the counter being settable to any desired stack count within a given range;

and stack accumulator control means for actuating the stack accumulator to remove a stack of objects from the stacking location each time a preset count is recorded in the counter.

7. A stacker according to claim 6 and further comprising a fixed stop member extending transversely of the conveyor belt at the discharge end of the belt to engage each object and assure consistent alignment of the objects as stacked.

8. A stacker according to claim 6 in which the shuttle drive means shifts the shuttle to its retracted position at a speed substantially greater than the conveyor belt speed but returns the shuttle to its extended position at a much lower speed, equal to or only slightly greater than the conveyor belt speed.

9. A stacker according to claim 9 in which the shuttle drive means comprises a double-acting fluid cylinder and piston, and in which the speed of shuttle movement is controlled by adjustment of the rate of exhaust of fluid from the cylinder.

10. A stacker according to claim 6 in which the object sensor means is a photoelectric sensor actuated by the object interrupting a light beam projected across the discharge end of the conveyor with the shuttle extended position.

11. A stacker according to claim 7 in which the control means includes shuttle sensor means to sense arrival of the shuttle at its retracted position, the shuttle sensor means comprising a count input for the counter and a control input for reversing the shuttle drive means.

* * * * *

UNITED STATES PATENT AND TRADEMARK OFFICE

CERTIFICATE OF CORRECTION

PATENT NO. : 4,137,604

DATED : February 6, 1979

INVENTOR(S) : Glenn A. Sandberg and George N. Howe

It is certified that error appears in the above-identified patent and that said Letters Patent are hereby corrected as shown below:

Claim 9, first line, change "9" to -- 8 -- ;

Claim 11, first line, change "7" to -- 6 --.

Signed and Sealed this

*Twenty-second* Day of *July 1980*

[SEAL]

*Attest:*

SIDNEY A. DIAMOND

*Attesting Officer*

*Commissioner of Patents and Trademarks*